United States Patent [19]

Hogue

[11] 4,387,872

[45] Jun. 14, 1983

[54] LATCH FOR A TAB AND SLOT MOUNTING BRACKET

[75] Inventor: Norman E. Hogue, Niles, Mich.

[73] Assignee: Packard Industries, Inc., Niles, Mich.

[21] Appl. No.: 274,435

[22] Filed: Jan. 17, 1981

[51] Int. Cl.[3] ..... A47B 57/00

[52] U.S. Cl. ..... 248/221.3; 248/243

[58] Field of Search ..... 248/221.3, 243; 211/192

[56] References Cited

U.S. PATENT DOCUMENTS

| | | | |
|---|---|---|---|
| 977,609 | 12/1910 | Freeman | 248/243 |
| 1,974,050 | 9/1934 | Keil | 248/243 |
| 2,534,952 | 12/1950 | Comer | 248/243 |
| 2,576,865 | 11/1951 | Vanderveld | 248/243 |
| 2,741,449 | 4/1956 | Heselov | 248/243 |
| 3,601,432 | 8/1971 | Fenwick et al. | 248/243 X |
| 3,697,034 | 10/1972 | Shell | 248/221.3 |

FOREIGN PATENT DOCUMENTS

| | | | |
|---|---|---|---|
| 231650 | 6/1963 | Austria | 248/243 |
| 383576 | 1/1965 | Switzerland | 248/243 |

*Primary Examiner*—William E. Lyddane
*Assistant Examiner*—Sarah A. Lechok
*Attorney, Agent, or Firm*—James D. Hall

[57] ABSTRACT

A latch for a mounting bracket system of hooked tabs and accommodating slots. The tabs fit into and hook onto a slotted receiver. A spring urged plunger extends into a slot above the inserted tab to prevent releasable movement of the tab from the receiver.

5 Claims, 8 Drawing Figures

LATCH FOR A TAB AND SLOT MOUNTING BRACKET

SUMMARY OF THE INVENTION

This invention relates to a latch which is for a mounting bracket and which will have special application to a bracket having hooked tabs and a receiver with slots for receiving the tabs in a hooked interlocking relationship.

Mounting brackets which use hooked tabs and slots are well known in the art. U.S. Pat. Nos. 3,966,158; 4,048,768; 4,133,433 and 4,154,419 describe mounting brackets of this nature with locks. Such lock systems are either complicated or cumbersome to use.

The present invention provides an improvement over the prior bracket lock systems. This invention utilizes a spring urged plunger positioned above a hooked tab. The plunger is normally extended and thereby automatically projects into a receiver slot upon insertion of the hooked tab into the receiver. In this manner, the lock between the tab and receiver becomes effective immediately without additional operations.

Accordingly, it is the object of this invention to provide a simple, improved means to lock a hooked tab base plate of a mounting bracket into a slotted receiver.

Another object is to provide a lock for a mounting bracket to prevent accidental dislodgement of the bracket from its receiver.

Other objects will become apparent upon a reading of the following description.

DESCRIPTION OF THE PREFERRED EMBODIMENT

Figure 1:
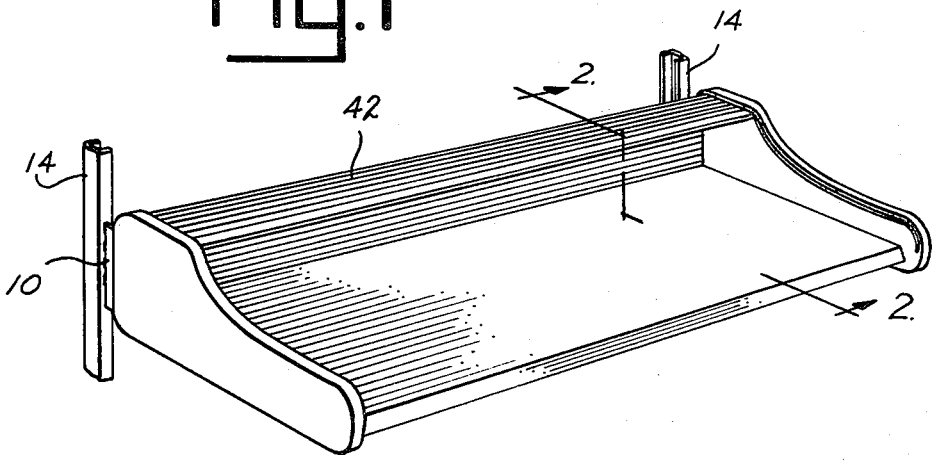
FIG. 1 is a perspective view of a desk utilizing the latch invention.
Figure 2:
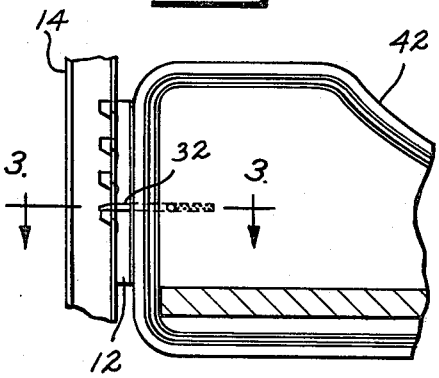
FIG. 2 is a fragmentary cross-sectional view of the invention taken along line 2—2 of FIG. 1.
Figure 4:
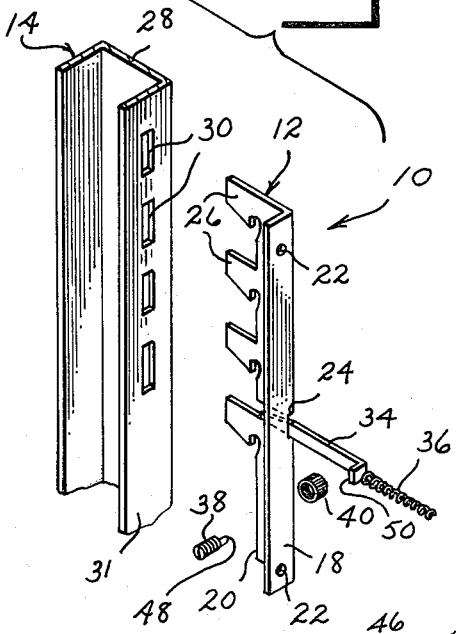
FIG. 4 is an exploded perspective view of the mounting bracket.

The preferred embodiment illustrated is not intended to be exhaustive or to limit the invention to the precise form disclosed. It is chosen and described in order to best explain the principles of the invention and its application and practical use to thereby enable others to utilize the invention.

Referring to the drawings, the mounting bracket 10 includes a base plate 12 and a receiver 14. Base plate 12 has a face plate 18 and an extension 20. Face plate 18 has mounting holes 22 formed in it. Vertically spaced, hooked tabs 26 project from extension 20. An opening 24 is formed in face plate 18 between two adjacent tabs 26. Receiver 14 has a channel-shaped body 28 with slots 30 formed in one flange 31.

A latch 32 forms a part of mounting bracket 10. Latch 32 includes a plunger 34 which extends through opening 24 of base plate 12 and is forwardly biased by a spring 36. Latch 32 includes a shifter 38 which is threadably mounted within a bushing 40.

Figure 3:
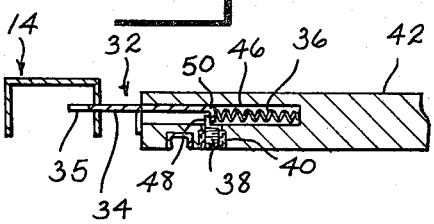
FIG. 3 is a cross-sectional view taken along line 3—3 of FIG. 2.
Figure 5:
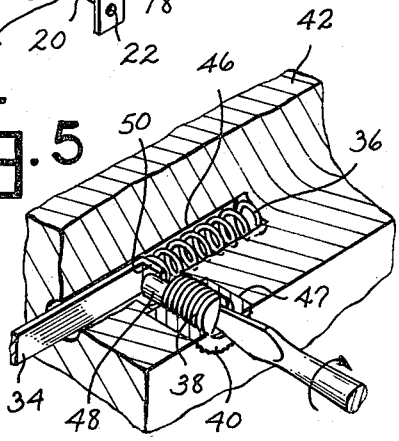
FIG. 5 is a fragmentary sectional view illustrating the latch plunger in extended position.

To utilize the invention, mounting bracket 10 is secured to a positionable object, such as a piece of furniture 42, shelf or other item. Initially, furniture 42 must be bored to accept spring 36, bushing 40 and the mounting screws 44 used to attach base plate 12. Spring 36 is inserted into bore 46. With spring 36 in place, plunger 34 is fitted into bore 46 and base plate 12 attached to furniture 42 with mounting screws 44. Tip 35 of plunger 34 is aligned with opening 24 in plate 12. Bushing 40 is then press fit into an intersecting cross bore 47 in furniture 42 with shifter 38 threaded therein. Plunger 34 is forced against and compresses spring 36 with cam 48 of shifter 38 engaging flange 50 of the plunger. Rotation of shifter 38 180° from the position shown in FIGS. 3 and 5 will urge plunger 34 due to the configuration of cam 48 from its shown extended position into a retracted position. Another 180° rotation of shifter 38 will return plunger 34 to its full extended position.

Figure 6:
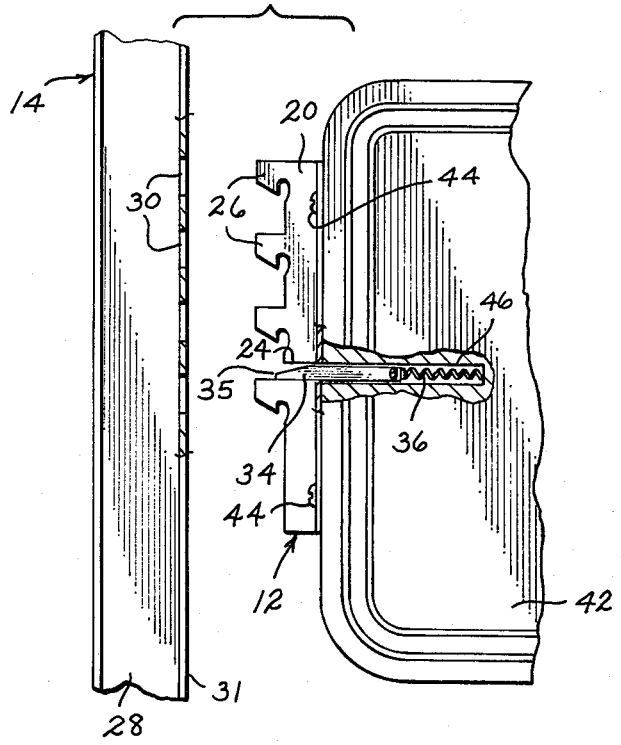
FIG. 6 is a side view showing the alignment of the base plate, receiver and latch prior to insertion.
Figure 7:
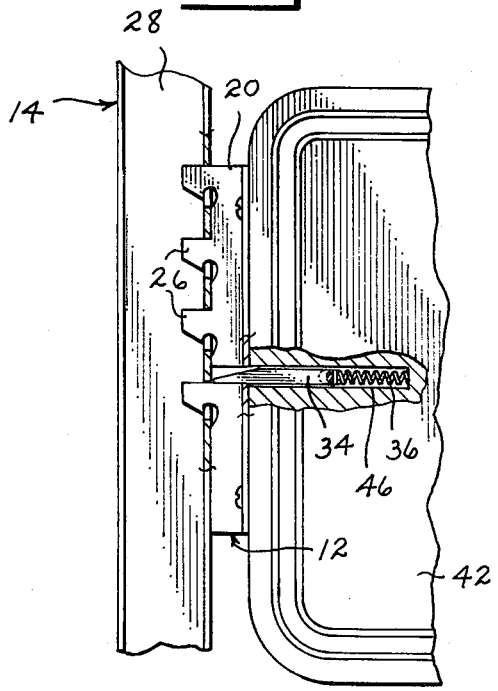
FIG. 7 is a view similar to that in FIG. 6 with the base plate being inserted.
Figure 8:
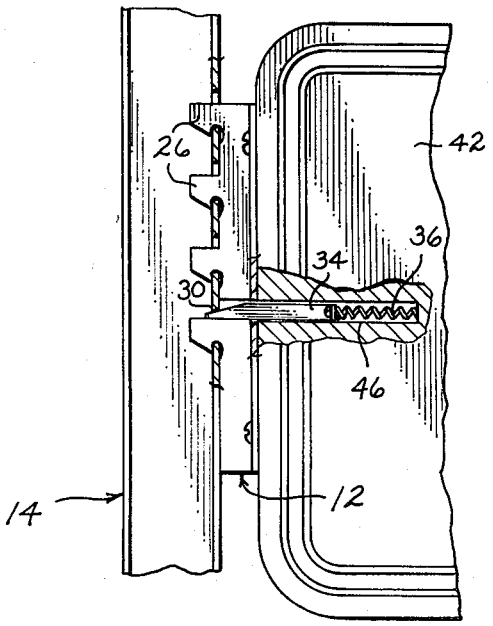
FIG. 8 is a view similar to that in FIG. 7 with the base plate inserted and latch engaged.

To secure furniture 42 in location, receivers 14 are secured, such as by screws, not shown, to a stanchion, wall or similar support. Hooked tabs 26 are first aligned with slots 30, as shown in FIG. 6, and then inserted into the slots, as shown in FIG. 7. As tabs 26 fit into slots 30, plunger 34 abuts receiver body 28 and is forced back against spring 36. As tabs 26 are hooked over the edges of slots 30, plunger 34 is forced forward by spring 36 into a slot 30 above a tab 26 as illustrated in FIG. 8. With plunger 34 wedged into slot 30, it becomes impossible to move base plate 12 upwardly relative to receiver 14 to dislodge tabs 26 from slots 30. Removal of tabs 26 is easily attained by means of a 180° rotation of shifter 38 to withdraw the plunger 34 from receiver 14.

It is understood that the invention is not to be limited to the preceding description but may be modified within the scope of the appended claims.

What I claim is:

1. In combination a mounting bracket and latch, said mounting bracket including a base plate and receiver having a slot therein, said base plate including a hooked tab means extending therefrom, said tab means for insertion into said receiver slot and interlocking with the receiver upon vertical movement relative to the receiver with a space being provided between the top of said tab means and the upper end of the receiver slot, said base plate carrying a positionable object, the improvement wherein said object includes a bore formed in general alignment with the top of said tab means, said latch including a plunger slidably positioned within said object bore, said plunger including a front end portion and a rear end portion, a spring contacting said plunger rear end portion and normally urging said plunger into an extended position with said plunger front end portion located over said tab means, said plunger front end portion contacting said receiver above said receiver slot and shifting said plunger into a retracted position when said tab means is inserted into said receiver slot, said spring urging said plunger into its said extended position with said plunger front end portion projecting into said receiver slot between said slot upper end and said tab means top upon said vertical movement of the tab means relative to the receiver whereby disengagement of the tab means from the receiver is prevented, rotatable cam means carried by said object and contacting said plunger at its rear end portion for urging said plunger into its retracted position upon rotation of the cam means to allow for withdrawal of the tab means from said receiver slot.

2. The combination of claim 1 wherein said base plate includes a plurality of hooked tab means and said receiver has a plurality of slots therein, each tab means being alignable with a said receiver slot, said plunger being located over one of said tab means.

3. The combination of claim 1 wherein said plunger rear end portion terminates in a transverse part, said cam means contacting said plunger transverse part to shift said plunger into its retracted position upon rotation of the cam means relative to said object.

4. The combination of claim 3 wherein said cam means is a threaded member, said object including a second bore intersecting said plunger receiving bore therein, said cam means being threaded into said object second bore.

5. The combination of claim 4 wherein said cam means includes an inner cam-defining end in contact with said plunger transverse part and a slotted exposed outer end adapted for engagement with the head of a turning tool wherein said cam means may be rotated to urge said plunger between its extended and retracted positions.

* * * * *

UNITED STATES PATENT AND TRADEMARK OFFICE

CERTIFICATE OF CORRECTION

PATENT NO. : 4,387,872

DATED : June 14, 1983

INVENTOR(S) : Norman E. Hogue

It is certified that error appears in the above-identified patent and that said Letters Patent are hereby corrected as shown below:

On the title page:

The filing date is amended to read: [22] Filed - June 17, 1981.

Signed and Sealed this

Ninth Day of August 1983

[SEAL]

Attest:

GERALD J. MOSSINGHOFF

Attesting Officer

Commissioner of Patents and Trademarks